US006160985A

United States Patent [19]

Hou

[11] Patent Number: 6,160,985

[45] Date of Patent: Dec. 12, 2000

[54] SYSTEM FOR MANAGING A WEB OF SHEET MATERIAL IN A PRINTING MACHINE

[75] Inventor: Ssujan Hou, Cheshire, Conn.

[73] Assignee: Xerox Corporation, Stamford, Conn.

[21] Appl. No.: 09/417,620

[22] Filed: Oct. 14, 1999

[51] Int. Cl.[7] ..... G03G 15/00

[52] U.S. Cl. ..... 399/384; 399/385

[58] Field of Search ..... 399/384, 381, 399/385, 386, 387, 364; 226/197; 347/153, 154

[56] References Cited

U.S. PATENT DOCUMENTS 4,154,386 5/1979 Kawada ..... 226/91

5,970,304 10/1999 Stemmle ..... 399/384 X

*Primary Examiner*—Arthur T. Grimley
*Assistant Examiner*—Hoan Tran
*Attorney, Agent, or Firm*—H. Fleischer; J. E. Beck

[57] ABSTRACT

A printing machine in which an endless web of sheet material is adapted to move along a path of movement. A recording device, in communication with the web of sheet material, prints information thereon. A fixing device, associated with the recording device, substantially permanently fixes the printed information to the web of sheet material. An inverter, positioned after the fixing device in the path of movement of the web of sheet material, inverts the sheet material enabling information to be printed on one side of the web of sheet material before inversion and information to be printed on the other side of the web of sheet material after inversion thereof.

6 Claims, 3 Drawing Sheets

SYSTEM FOR MANAGING A WEB OF SHEET MATERIAL IN A PRINTING MACHINE

The present invention relates to an electrophotographic printing machine, and more particularly concerns the management of an endless web of sheet material used therein.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, a developer mix is brought into contact therewith. This forms a powder image on the photoconductive member which is subsequently transferred to a copy sheet. Finally, the copy sheet is heated to permanently affix the powder image thereto in image configuration.

In today's high speed electrophotographic printing machines, rather than using cut sheets as the copy sheets, a web of sheet material may be used. The web of sheet material is advanced from a roller through the transfer station in the printing machine to receive the toner powder images thereon from the photoconductive member. In a machine of this type, the photoconductive member is frequently a photoconductive belt. A photoconductive belt has a seam. One of the major challenges for a photoconductive belt printing machine that uses a continuous web of sheet material is the management of the photoconductive belt seam. Because of non-conformance in the surface flatness and the photoconductive properties near the seam area, the seam is not used for imaging and is skipped. If a continuous web of sheet material passes the transfer station with no intervention, the unimaged may not be in registration with the image developed on the photoconductive belt. For a long photoconductive belt, i.e., one that can hold 13 continuous 8.5 inch size images, more than seven percent of the web of sheet material is scrapped at this 13 to 1 ratio. For photoconductive belts holding more image pitches, this increases. In addition to managing the web of sheet material with respect to the photoconductive to belt seam, the web of sheet material must also be inverted so as to enable duplex printing thereon. Thus, it is highly desirable to be capable of managing the continuous web of sheet material so that transfer of the toner powder image thereto is achieved without wasting sheet material, as well as being capable of inverting the continuous web of sheet material to achieve is both simplex and duplex printing thereon.

Various approaches have been devised to change the orientation of a web of sheet material. The following disclosure may be relevant to various aspects of the present invention:

U.S. Pat. No. 4,154,386

Patentee: Kawada

Issued: May 15, 1979

The relevant portion of the foregoing disclosure may be briefly summarized as follows:

U.S. Pat. No. 4,154,386 discloses a pair of turning bars disposed parallel to each other at an angle of 45° with respect to a paper path. Guide plates are disposed on one side of the passage of the paper before and after the turn bars.

In accordance with one aspect of the features of the present invention, there is provided a printing machine including an endless web of sheet material adapted to move along a path of movement. A recording device in communication with the web of sheet material prints information thereon. A fixing device, associated with the recording device, substantially permanently fixes the printed information to the web of sheet material. An inverter, positioned after the fixing device, in the path of movement of the web of sheet material, inverts the web of sheet material, enabling information to be printed on one side of the web of sheet material before inversion thereof and information to be printed on the other side of the web of sheet material after inversion thereof.

Pursuant to another aspect of the present invention, there is provided an apparatus for moving an endless web of sheet material in a printing machine of the type having a recording device, in communication with the web of sheet material, to print information thereon and a fixing device associated with the recording device for substantially permanently fixing the printed information to the web of sheet material. An inverter, positioned after the fixing device in the path of movement of the web of sheet material, inverts the web of sheet material enabling information to be printed on one side of the web of sheet material before inversion thereof and information to be printed on the other side of the web of sheet material after inversion thereof. A cutting device, positioned before the recording device in the path of movement of the web of sheet material, cuts the web of sheet material after information has been recorded on one side thereof and before information has been recorded on the other side thereof.

In still another aspect of the present invention, there is provided a method of printing, including moving an endless web of sheet material along a path of movement and printing information on the web of sheet material. The printed information on the web of sheet material is fixed thereto. After fixing the printed information to one side of the web of sheet material, the web of sheet material is inverted, enabling information to be printed on the other side thereof. The web of sheet material is cut after information has been printed on one side thereof and before information has been printed on the other side thereof.

Other aspects of the present invention will become apparent as the following description proceeds and upon reference to the drawings, in which.

While the present invention will hereinafter be described in connection with a preferred embodiment and method of use thereof, it will be understood that it is not intended to limit the invention to that embodiment or method of use. On the contrary, it is intended to cover all alternatives, modifications, and equivalents that may be included within the spirit and scope of the invention as defined by the appended claims.

Figure 1:
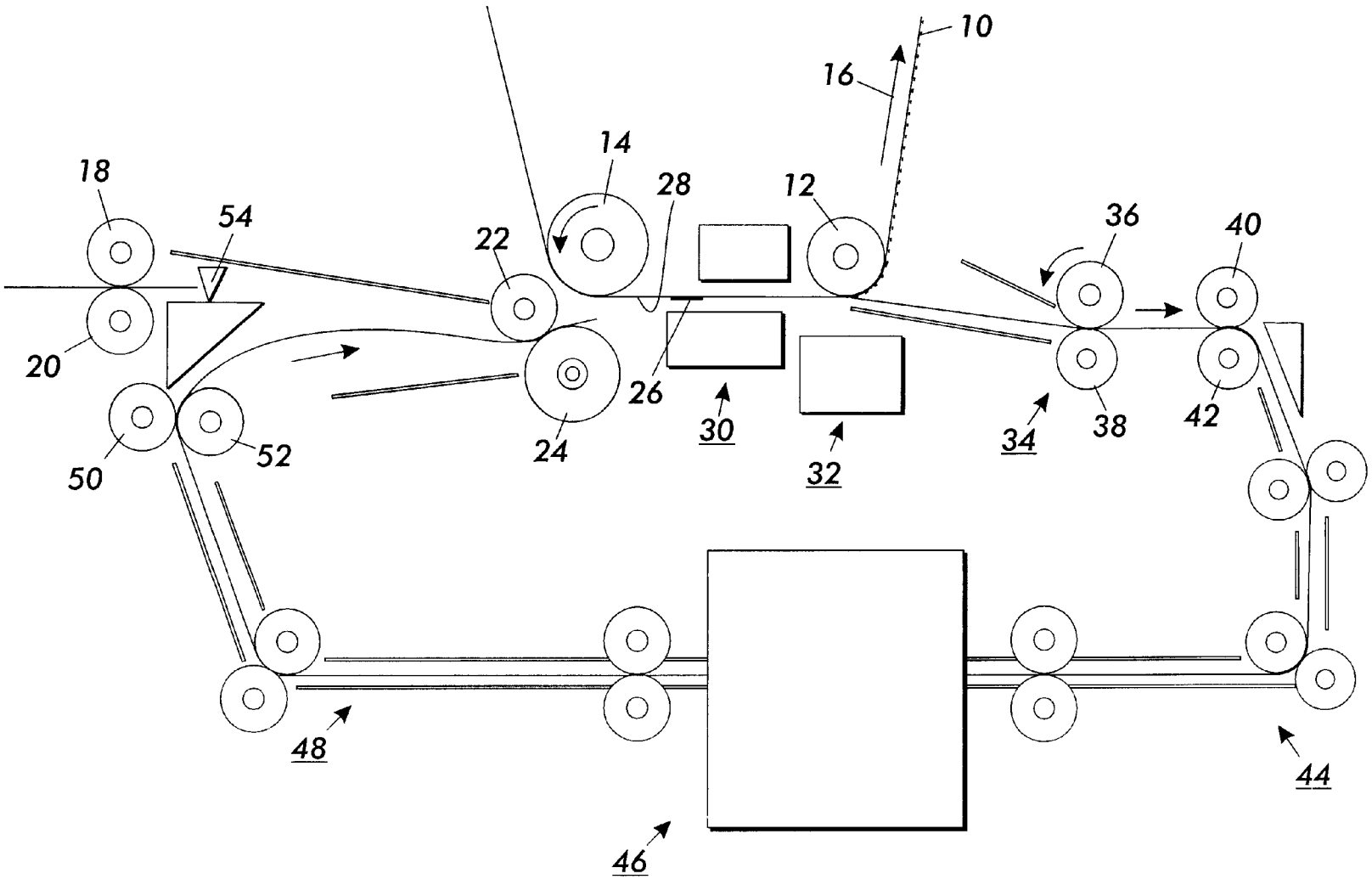
FIG. 1 is a schematic, elevational view showing the endless loop through which the web of sheet material passes in the printing machine.
Figure 2:
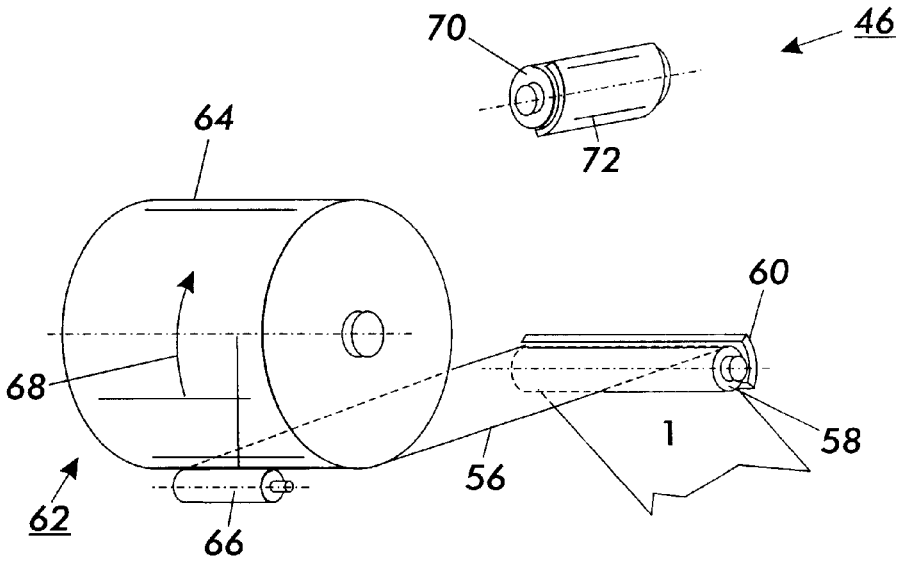
FIG. 2 is a schematic, perspective view of the FIG. 1 inverter.
Figure 3:
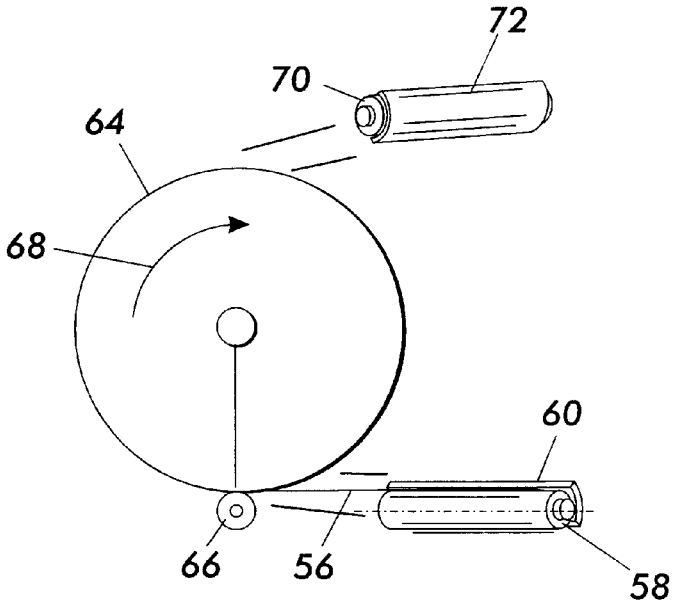
FIG. 3 is an elevational view of the FIG. 2 inverter.
Figure 4:
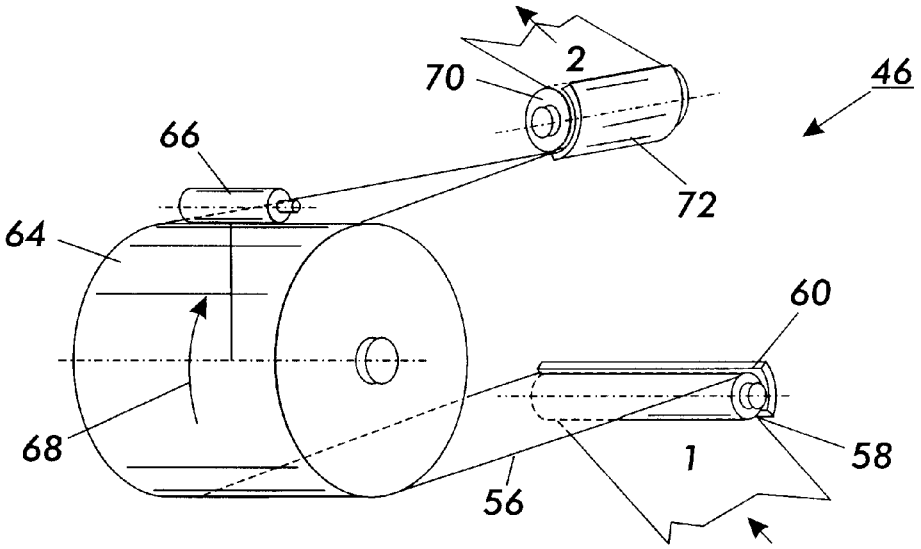
FIG. 4 is another a schematic perspective view of the inverter.
Figure 5:
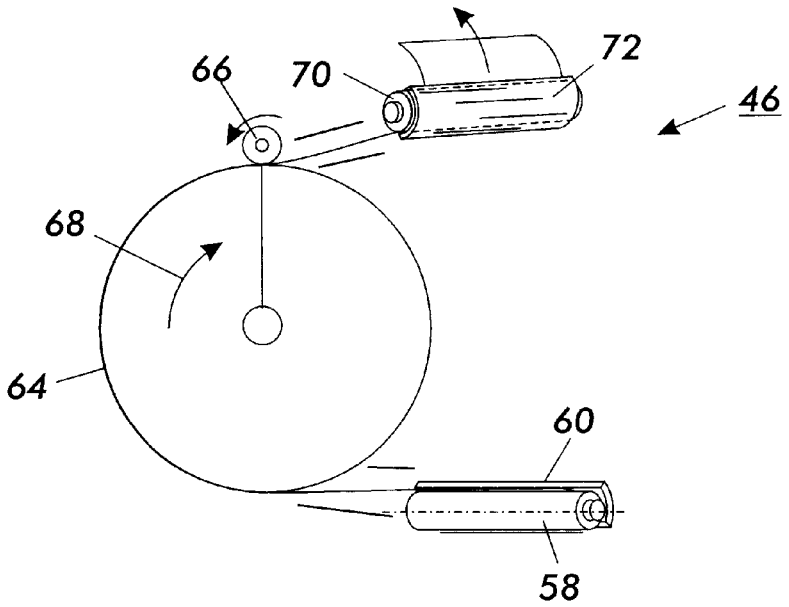
FIG. 5 is an elevational view of the FIG. 4 inverter.

For a general understanding of the features of the present invention, initially an exemplary electrophotographic printing machine will be briefly described. It will become apparent from the following discussion that the management system for the web of sheet material is equally well-suited for a wide variety of printing machines and is not necessarily limited in this application to an electrophotographic printing machine. With reference to FIG. 1, the illustrative electrophotographic printing machine employs a photoconductive belt 10. The photoconductive belt is entrained about a stripping roller 12, a tensioning roller (not shown ), and a drive roller 14. Stripping roller 12 is mounted rotatably so as to rotate with photoconductive belt 10. The tensioning roller is resiliently urged against photoconductive belt 10 to maintain the belt under the desired tension. Drive roller 14 is rotated by a motor coupled thereto by suitable means such as a belt drive. A controller controls the motor in a manner well known to one skilled in the art to rotate drive roller 14. As drive roller 14 rotates, it advances photoconductive belt 10 in the direction of arrow 16.

Initially, a portion of the photoconductive surface passes through a charging station (not shown). The charging station has a corona generating device which charges the photoconductive surface of photoconductive belt 10 to a relatively high, substantially uniform, potential.

Thereafter, the charged portion of the photoconductive surface of belt 10 is exposed to a light image corresponding to the document being printed. This records an electrostatic latent image on the photoconductive surface of belt 10 which corresponds to the information areas contained within the document being printed. After imaging, belt 10 advances the electrostatic latent image recorded on the photoconductive surface to a development station (not shown). At the development station, a magnetic brush developer unit advances developer material into contact with the electrostatic latent image recorded on the photoconductive surface of belt 10. The latent image attracts toner particles from the magnetic brush developer unit to form a toner powder image thereon. Inasmuch as photoconductive belt 10 is relatively long and includes a plurality of pitches, i.e., regions in which different pages of information may be recorded thereon, it is necessary to control the imaging region so as to not fall on the belt seam. Each image region on the photoconductive belt containing the developed image is advanced sequentially to the transfer station of the printing machine. At transfer station 30 of the printing machine, the web of sheet material is advanced thereto to receive successive pages of information thereon in each pitch or image region of the photoconductive belt. For example, the photoconductive belt may contain 13 pitches, i.e., 13 image regions, with each image region or pitch having an 8.5×11 inch page of information thereon. Thus, the photoconductive belt may have simultaneously multiple pages of information thereon which are transferred sequentially to successive regions of the web of sheet material. Each region of the web of sheet material corresponds to one page of information recorded on the photoconductive belt. This information may be printed on one side of the web of sheet material, i.e., simplex printing or on opposed sides thereof, which corresponds to duplex printing.

After the developed toner image has been transferred to the web of sheet material, the web of sheet material with the developed image thereon is advanced to a fusing station 34 where the information printed thereon is permanently affixed to the sheet material.

After transfer, the residual particles adhering to the photoconductive belt are cleaned therefrom. The particles are cleaned from the photoconductive belt by the rotation of a brush in contact therewith. Subsequent to cleaning, a discharge lamp floods the photoconductive belt with light to dissipate any residual or electrostatic charge remaining thereon prior to the charging thereof for the image.

A programmable microprocessor controls all of the machine steps and functions heretofore described. The controller controls the gates, drive rollers, etc., and also provides full control of the operator selected switches, time delays, jam correction control, etc. In addition, the inverter of the present invention may similarly be controlled by this microprocessor. Exemplary control systems for use in conjunction with electrophotographic printing machines and the printing machines themselves are described in U.S. Pat. No. 4,062,061, issued Dec. 6, 1977 to Battler, et al., U.S. Pat. No. 4,132,155, issued Oct. 31, 1978 to Puerto, U.S. Pat. No. 4,125,325, issued Nov. 14, 1978 to Battler, et al., and U.S. Pat. No. 4,144,550 issued Mar. 13, 1979 to Donohue, et al. The relevant portions of the foregoing patents are incorporated into the present application.

It is believed that the foregoing description is sufficient for purposes of the present application to illustrate the general operation of an electrophotographic printing machine incorporating the present invention therein.

With continued reference to to FIG. 1, the present invention will be described hereinafter in greater detail. A roll of sheet material is positioned such that the lead edge thereof, i.e., the lead edge of the web of sheet material, is advanced into the nip defined by drive rollers 18 and 20. The unimaged web of sheet material passes through a pre-transfer buckle chamber and the lead edge thereof is stopped at the nip defined by rollers 22 and 24. The nip defined by rollers 22 and 24 is open to receive the lead edge of the web of sheet material after seam 26 on photoconductive belt 10 passes the transfer point 28 at transfer station 30. As rollers 22 and 24 advance the lead edge of the web of sheet material, it is captured and tacked to photoconductive belt 10 at transfer station 30. Transfer station 30 includes a corona generating device which sprays ions onto the back side of the web of sheet material to attract the toner powder image from photoconductive belt 10 thereto. After the toner powder image has been transferred to the web of sheet material at transfer station 30, a detack corona generating device 32 sprays ions onto the back side of the web of sheet material to assist in stripping the web of sheet material from photoconductive belt 10. After the lead edge of the web of sheet material is stripped from photoconductive belt 10, it advances through fusing station 34. Fusing station 34 includes a heated fuser roller 36 and a pressure roller 38. A buckle in the web of sheet material is formed after the lead edge of sheet material passes through the nip defined by fuser roll 36 and pressure roller 34. The buckle in the web of sheet material isolates the motion post transfer from that occurring at transfer to prevent smearing of the image being transferred to the web of sheet material. The web of sheet material with the image fused thereto on one side thereof, is then driven by drive rollers 40 and 42 to reroute transfer path 44 which comprises a plurality of drive rollers. Reroute transfer path 44 advances the lead edge of the web of sheet material through an inverter, indicated generally by the reference number 46. Transport 48, which also comprises a plurality of rollers, advances the lead edge of the inverted web of sheet material to drive rollers 50 and 52. When the length of the web of sheet material passing drive rollers 18 and 20 is equal to the number of pitches on photoconductive belt 10, i.e., the number of image pitches is equal to the length of the web of sheet material extending from drive rollers 18 and 20 to the lead edge of the web of sheet material stopped at the nip of drive rollers 50 and 52. Thus, the path through which the web of sheet material moves in one cycle is of the same length as the number of pitches on the photoconductive belt 10 or the number of images recorded on the photoconductive belt 10 during one cycle. For example, if the number of pitches on the photoconductive belt is 10, and each pitch is 8.5 inches long, the length of the web of sheet material is 85 inches.

Of course, if the number of pitches on the photoconductive belt is of a lesser number than the length of the sheet path, it will not be equal to the number of pitches and the web of sheet material will be cut at a length corresponding thereto even though the path of movement of the web of sheet material during one cycle is greater. When the length of sheet material corresponds to the number of pitches on the photoconductive belt, slitter 54 cuts the web of sheet material and separates those portions of the web of sheet material having images fused thereto into a cut sheet segment from the remainder of the web of sheet material. At this time, drive rollers 18 and 20 stop and hold the reminder of the web of sheet material in place. Thereafter, drive rollers 50 and 52 advance the cut segment of the web of sheet material to the transfer station 30 after seam 26 on belt 10 has passed transfer point 28. The toner powder images are then transferred to the opposite side of the cut segment of the web of sheet material forming a duplex image thereon. The cut segment of web of sheet material is advanced through fusing station 34 so as to permanently fuse the toner powder image to the opposed side thereof. In this way, toner images are affixed permanently to both sides of the cut segment of the web of sheet material. The cut segment of the web of sheet material is then advanced to the finishing station where it may be subsequently removed from the printing machine by the operator.

Referring now to FIGS. 2–5 inclusive, the details of inverter 46 will be described hereinafter. The web of sheet material 56 with side 1 imaged, enters the clearance between a first turn roll 58 and a guide plate 60 which is curved about the peripheral face of turn roll 58. Turn roll 58 and guide plate 60 are oriented at an angle of about 45° with respect to the path of movement. The lead edge of the web of sheet material turns about 90° to the edgewise direction after passing over turn roll 58. After exiting turn roll 58, the leading edge of the web of sheet material enters intermediate transport 62. Intermediate transport 62 includes a roller and an idler in engagement therewith defining a nip. Roller 64 is a drive roller. The lead edge of the web of sheet material advances into the nip defined by roller 64 and idler 66. Roller 64 rotates in the direction of arrow 68. The lead edge of the web of sheet material rotates 180° with the rotation of roller 64 and the movement of orbiting idler roller 66 which moves with roller 68 so as to advance the leading edge of the web of sheet material through an angle of about 180°. After the leading edge of the web of sheet material has rotated through about 180°, the leading edge is advanced to turn roller 70. Turn roller 70 also includes a guide plate 72 which is spaced from turn roller 70 to define a clearance through which the lead edge of the web of sheet material passes. Turn roller 70 and guide plate 72 are oriented at about a 45° angle with respect to the path of movement of the web of sheet material. In this way, the lead edge of the web of sheet material turns 90° with respect to the original path of movement thereof. Thus, the web of sheet material entering inverter 46 and the web of sheet material exiting inverter 46 are substantially parallel to one another. The web of sheet material is inverted as it passes through inverter 46 so that side 2 is face up exiting inverter 46 while side 1 was face up entering inverter 46. After the web of sheet material exits inverter 46, side 2 is now ready to receive the toner powder image at transfer station 30.

In recapitulation, it is clear that the management system for the web of sheet material used in an electrophotographic printing machine inverts the web of sheet material, cuts the web of sheet material after the first side has had the information printed thereon, and prints the information on the second side of the cut segment of the web of sheet material. Furthermore, this system manages the movement of the web of sheet material such that the seam on the photoconductive member does not result in any scrap sheets or portions thereof of the web of sheet material.

It is therefore evident that there has been provided in accordance with the present invention a system which fully satisfies the aims and advantages hereinbefore set forth. While this invention has been described with the specific embodiment and method of use thereof, it is evident that many alternatives, modifications, and variations will be apparent to those skilled in the art. Accordingly, it is intended to embrace all such alternatives, modifications, and variations that fall within the spirit scope of the appended claims.

What is claimed is:

1. A printing machine, including:

an endless web of sheet material adapted to move along a path of movement;

a recording device, in communication with said web of sheet material, to print information thereon, said recording device comprising a photoconductive member having a toner image developed thereon corresponding to information being printed on said web of sheet material, said photoconductive member comprising a belt moving in a recirculating path and having a plurality of image regions thereon with each image region being adapted to have a toner image developed thereon, and said web of sheet material advancing along the path of movement wherein the path of movement thereof corresponds to a closed loop with said web of sheet material in the closed loop being of a length substantially equal to the number of image regions on said belt in one cycle of recirculating movement thereof;

a fixing device associated with said recording device for substantially permanently fixing the printed information to said web of sheet material; and an inverter, positioned after said fixing device in the path of movement of said web of sheet material, to invert said web of sheet material enabling information to be printed on one of side of said web of sheet material before inversion thereof and information to be printed on the other side of said web of sheet material after inversion thereof.

2. A printing machine according to claim 1, further including a cutting device, positioned before said recording device in the path of movement of said web of sheet material, for cutting said web of sheet material after information has been recorded on one side thereof and before information has been recorded on the other side thereof.

3. A printing machine according to claim 2, wherein said inverter includes:

a first bar, positioned to receive said web of sheet material after information has been recorded on one side, to turn the path of movement of said web of sheet material about 90 degrees;

an intermediate transport, positioned to receive said web of sheet material after said web of sheet material has been turned about 90 degrees by said first bar, to rotate said web of sheet material about 180 degrees; and a second bar, positioned to receive said web of sheet material after said web of sheet material has rotated about 180 degrees, to turn the path of movement of said web of sheet material about 90 degrees so that the path of movement of said web of sheet material entering said first bar and exiting said second bar are substantially parallel to one another with said web of sheet material being inverted.

4. A printing machine according to claim 3, wherein said recording device includes a transfer station positioned adjacent said photoconductive member along the path of movement of said web of sheet material, comprising a charging device to charge said web of sheet material to attract the toner image from said photoconductive member thereto.

5. A printing machine according to claim 4, wherein said belt includes a seam, said cutter cutting said web of sheet material when said belt seam is positioned immediately prior to a transfer point.

6. A printing machine according to claim 5, wherein the length of said web of sheet material cut by said cutter is substantially equal to the number of image regions on said belt in one cycle of recirculating movement thereof.

* * * * *